United States Patent [19]

McMullan et al.

[11] 4,187,568

[45] Feb. 12, 1980

[54] WATER BED TRANSDUCER

[76] Inventors: James P. McMullan; Albert Stevens, both of 2630 Seaman Ave., El Monte, Calif. 91733

[21] Appl. No.: 906,240

[22] Filed: May 15, 1978

[51] Int. Cl.[2] ..... A47C 27/08; A61G 7/04; A61H 1/00; A47D 9/02

[52] U.S. Cl. ..... 5/451; 5/109; 128/33

[58] Field of Search ..... 5/370, 371, 368, 367, 5/365, 109, 449–452, 455, 456; 128/33, 1 C

[56] References Cited

U.S. PATENT DOCUMENTS

| | | | |
|---|---|---|---|
| 3,529,311 | 9/1970 | Crawford | 5/109 |
| 3,872,526 | 3/1975 | Betts | 5/370 |
| 4,114,215 | 9/1978 | Santo | 5/370 |

*Primary Examiner*—Alexander Grosz

*Attorney, Agent, or Firm*—Georges A. Maxwell

[57] ABSTRACT

A vibratory transducer in combination with a water bed structure including a frame with vertical side walls, a horizontal platform within the frame and a water filled bladder mattress within the frame and supported by the platform; said transducer includes a body in seated engagement in a corner established by the top of the platform on the inner surface of one side wall, said body has an inwardly and upwardly disposed inner side with an access opening extending diagonally across said corner; a drive plate is engaged with the mattress and overlies said inner side in spaced relationship, means is provided to couple the plate with the body for limited movement relative thereto; an electro magnetic vibrator is fixed to the plate to project freely through said access opening and into the body and is operable to vibrate the plate and transmit vibratory motion into and through the mattress.

6 Claims, 8 Drawing Figures

W
W'
F
M
2
U
A
14
L
P
20
3
C
B
V
10
I
11
12
5
4

WATER BED TRANSDUCER

This invention has to do with a water bed vibrator and is particularly concerned with a novel water bed transducer unit.

In the bedding art, it is common practice to suitably secure transducers or electrically powered vibrators to bed structures to effect vibration of the beds so that persons lying on the beds are subjected to vibrations at rates or frequencies and at magnitudes which physically relax the persons on the beds.

Water beds commonly include bladder-like water filled mattresses supported on the tops of rigid platforms established of plywood or the like and are contained about their perimeters by frames including vertical rails or side walls projecting upwardly from the platforms.

Vibrator means for water beds commonly include electro-magnetic transducers or vibrators secured to the bottom sides of the bed platforms. In such structures, the transducers operate to vibrate the bed platforms as well as the frames related thereto. The vibrating motion imparted into the platforms and frames is transmitted into and through the mattresses to the persons lying on top of the mattresses.

The platforms in such prior art structures and on which the transducers are mounted act as sound boards with the result that the structures are extremely noisy when in use. Further, the platforms are such that they absorb a large amount and disperse the motive energy of the vibrators that it is not infrequent that little of the motion sought to be attained is transmitted into and through the mattresses in an effective manner.

The above noted mounting of transducers on the bottom surfaces of water bed platforms is ordinarily dictated by the substantial dimensional sizes of the electro magnetic vibrators or transducers that are employed. The transducers are of a size that if they were engaged atop the platforms they would create obstructive protruberances which would likely damage the mattress and which would interfere with the satisfactory and intended use of the beds. As a result of the foregoing, the transducers can only be effectively related and mounted to the underside of the platforms, which mounting can only be effected prior to assembly of the beds. Further, such application and mounting of transducers can only be effected on those beds where the clearances between the platforms and their related supporting floor structures are sufficient to accommodate the transducers.

As a result of the above prior art practices, transducers cannot be related to assembled bed and mattress structures and cannot be related to the great number of percentage of water bed structures where the platforms of the beds are in close proximity to their related supporting floor structures.

An object and feature of our invention is to provide a novel transducer unit for installation in a water bed structure to impart vibratory motion into and through the mattress of the bed structure.

It is an object and feature of our invention to provide a transducer unit for the purpose set forth above which is removably engageable in an inside corner portion of a water bed structure established by the top of the bed platform and a side wall of the bed frame and which is engageable with that portion of the water bed mattress normally engageable in that corner portion.

It is an object and feature of our invention to provide a transducer of the character referred to above that can be easily and conveniently engaged in and with an assembled bed structure and in a bed structure wherein inadequate space occurs beneath the bed platform to accommodate a vibrator or transducer.

It is an object and feature of our invention to provide a transducer which, when related to a water bed, produces materially less sound than transducers fixed to and carried by water bed platforms and which is such that the ratio of power into motion out generated by the transducer and imparted into and through a related mattress, is far greater than is attained by the prior art.

It is an object and feature of our invention to provide a transducer unit of the general character referred to above which includes a body engageable in a corner established by a related water bed platform and frame side wall, a moveable plate, shock mounted on and carried by said body to occur between the body and the adjacent opposing portion of a related water bed mattress and an electro magnetic vibrator fixed to the plate at the surface thereof disposed toward said body.

Yet another object and feature of our invention is to provide a transducer of the character referred to above wherein the plate is a flat plate extending diagonally across its related inside corner of its related bed structure whereby the plane of said flat plate converges with the planes of the related platform and side wall at obtuse angle corners in and about which the mattress can readily safely and uniformly seat.

Still further, it is an object and feature of our invention to provide a structure of the character referred to above wherein the transducer has angularly disposed fairings which cooperate with the platform and side wall of a related water bed structure to eliminate the presence of recesses and corners within the bed structures and about the transducer in which related portions of the related water bed mattress could not be safely and effectively engaged and supported.

Finally, it is an object and feature of our invention to provide a transducer of the general character referred to above in combination wth a water bed structure of the general character referred to above wherein the transducer is arranged and disposed within the bed structure in a position where it does not establish an obstruction or protruberance within the bed structure which might adversely affect the utility of said bed structure.

The foregoing and other objects and features of our invention will be fully understood from the following detailed description of typical preferred forms and applications of our invention throughout which description reference is made to the accompanying drawings, in which:

FIG. 7 is an isometric view of another emmbodiment of our invention; and

Figures 1, 2, 3, 4, 5:
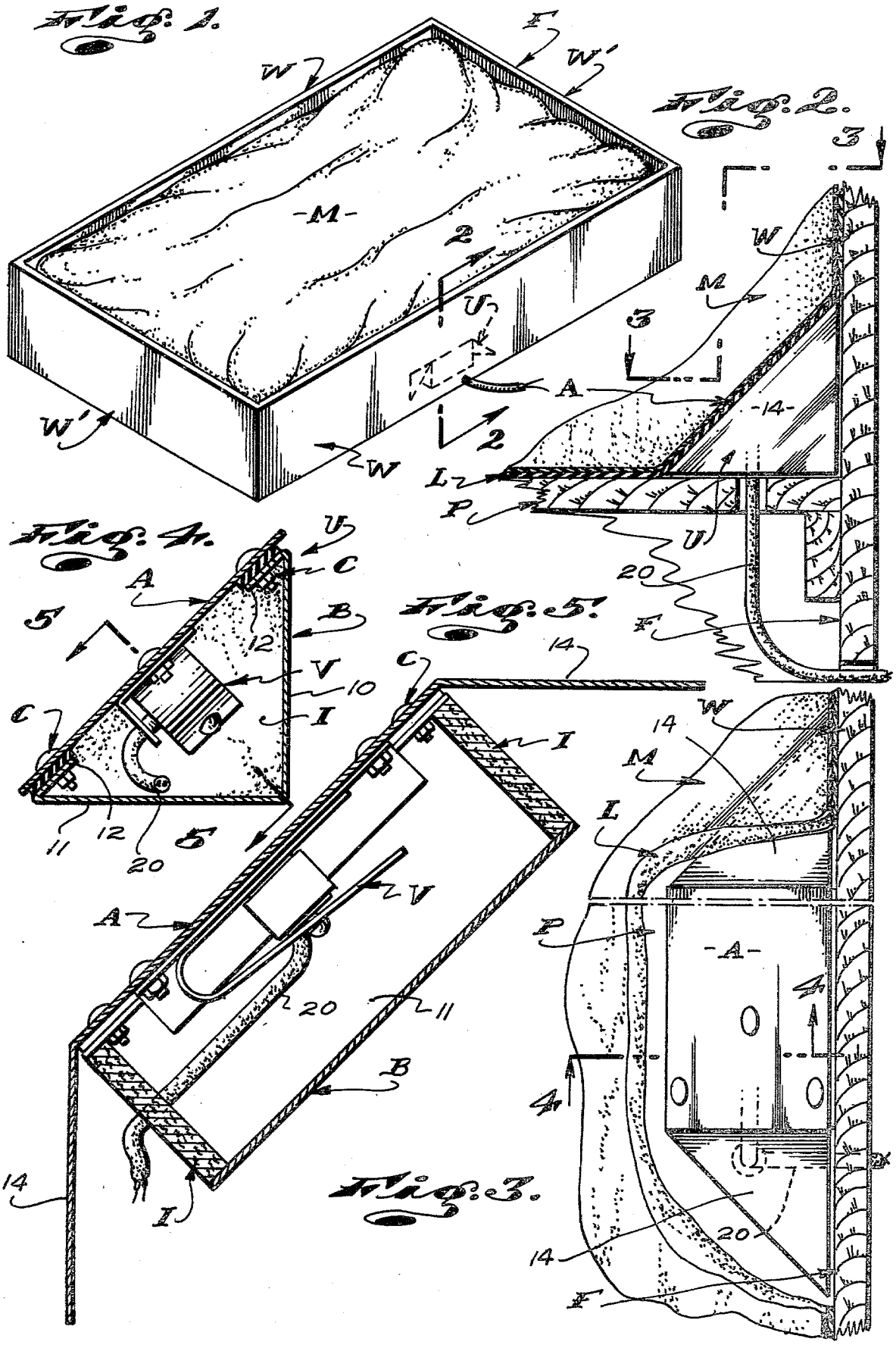
FIG. 1 is an isometric view of a water bed with out transducer related to it.
FIG. 2 is an enlarged sectional view taken as indicated by line 2—2 on FIG. 1.
FIG. 3 is a view taken substantially as indicated by line 3—3 on FIG. 2.
FIG. 4 is a view taken substantially as indicated by line 4—4 on FIG. 3.
FIG. 5 is a view taken substantially as indicated by line 5—5 on FIG. 4.

Referring to FIGS. 1, 2 and 3 of the drawings, the transducer unit U that we provide is shown related to a typical water bed structure.

The bed comprises a rectangular wooden frame F including vertical side wall W and end walls W'. Supported within the frame F is a flat horizontal platform P. The platform P is, for example, established by plywood and is spaced below the rim or upper edge of the frame a distance substantially equal to the vertical thickness or depth of a related mattress M.

The mattress M can, for example, be from 7" to 9" thick. The mattress M comprises a flexible plastic film bladder filled with water.

In practice, the mattress bladder has a suitable filler stem (not shown) to effect filling and draining water from the bladder, as circumstances require.

Further, in practice, and as shown in FIGS. 2 and 3 of the drawings, a liner L of flexible plastic film is arranged within the frame F and atop the platform P to guard the mattress bladder against defects in the frame and platform structure that might otherwise tear and damage the bladder.

The transducer unit U that we provide is arranged in seated engagement in a portion of the upper inside corner established by the platform and one of the side walls W. The unit U occurs adjacent and supports that portion of the liner L and mattress bladder which would normally engage and seat in the corner portion of the bed structure in which the unit U is engaged.

The unit U includes a body B, a drive plate A, coupling means C coupling the plate A with the body and an electro-magnetic vibrator V fixed to the plate.

In addition to the foregoing, the unit U is provided with sound insulating means I.

In our preferred carrying out of the invention, the body B is a unitary structure formed of sheet metal and defines or has a flat vertical side wall 10 and a flat horizontal bottom wall 11. The walls 10 and 11 are rectangular in plan configuration. The side wall 10 has horizontal top and bottom edges and vertical end edges and the bottom wall has horizontal inner, outer and end edges. The bottom and outer edges of the walls 10 and 11 are integrally joined. The top edge of the side wall 10 has a downwardly and inwardly projecting longitudinally extending mounting flange 12 formed integrally thereon and the inner edge of the bottom wall has an upwardly and outwardly projecting longitudinal mounting flange 12 formed integrally thereon. The flanges 12 are on a common plane at, for example, 45° relative to the planes of the walls 10 and 11 and extend diagonally between the top and outer edges of said walls. The flanges 12 cooperate to define what can be said to be an upwardly and inwardly disposed inner side of the body and are spaced apart to define what is in effect an inwardly and upwardly disposed access opening to the interior of the body.

In accordance with the above, the body B is triangular in cross-section, has open ends and an inner side with an upwardly and inwardly disposed access opening.

The side wall 10 of the body B of our transducer establishes flat bearing engagement on the inside surface of the side wall W of its related water bed frame F while the bottom wall 11 establishes flat bearing engagement on the top surface of the platform P of said bed, as clearly shown in FIGS. 2 and 3 of the drawings. Accordingly, the body B conforms with and seats in the corner established by its related side wall W and platform P.

The plate A of the unit U is a flat rectangular metal plate corresponding in plan configuration with the inner side of the body B and arranged in inward spaced parallel relationship therewith to overlie the access opening into the body.

The plate A is coupled with the body B by coupling means C which will hereinafter be described.

In the preferred carrying out of our invention, the plate A is provided with wing-like extensions or fairings 14 at its ends. The fairings are formed and angularly related to the plate A and to the platform P and side wall W of the bed structure so that they establish longitudinally outwardly tapered fillets at the opposite ends of the unit U to support portions of the liner L and mattress M adjacent thereto and which would otherwise be urged and drawn over sharp end edges of the plate A and into deep pocket like recesses at the ends of the unit. In the case illustrated, the fairings 14 are flat longitudinally outwardly convergent triangular shaped extensions at the ends of the plate and occur on planes at angles of 45° relative to the plane of the plate. The angles of the side edges of the fairings are such that the outer edges thereof oppose the inside surfaces of the side wall W in close spaced parallel relationship therewith and so that the lower edges of said fairings oppose the top surface of the platform P in close spaced parallel relationship therewith, as clearly illustrated in FIGS. 2 and 3 of the drawings.

The coupling means C functions to support the plate A on the body B for substantial free relative movement of the plate A relative to the body B within a small or limited range of movement.

Figure 6:
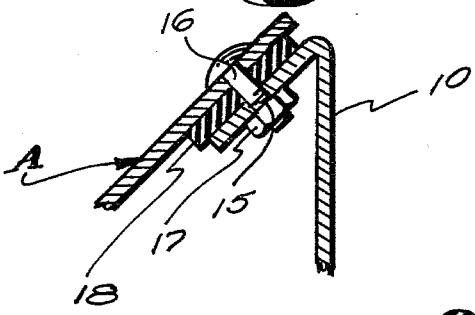
FIG. 6 is an enlarged detailed sectional view of a portion of the structure shown on FIG. 4.
Figure 2:
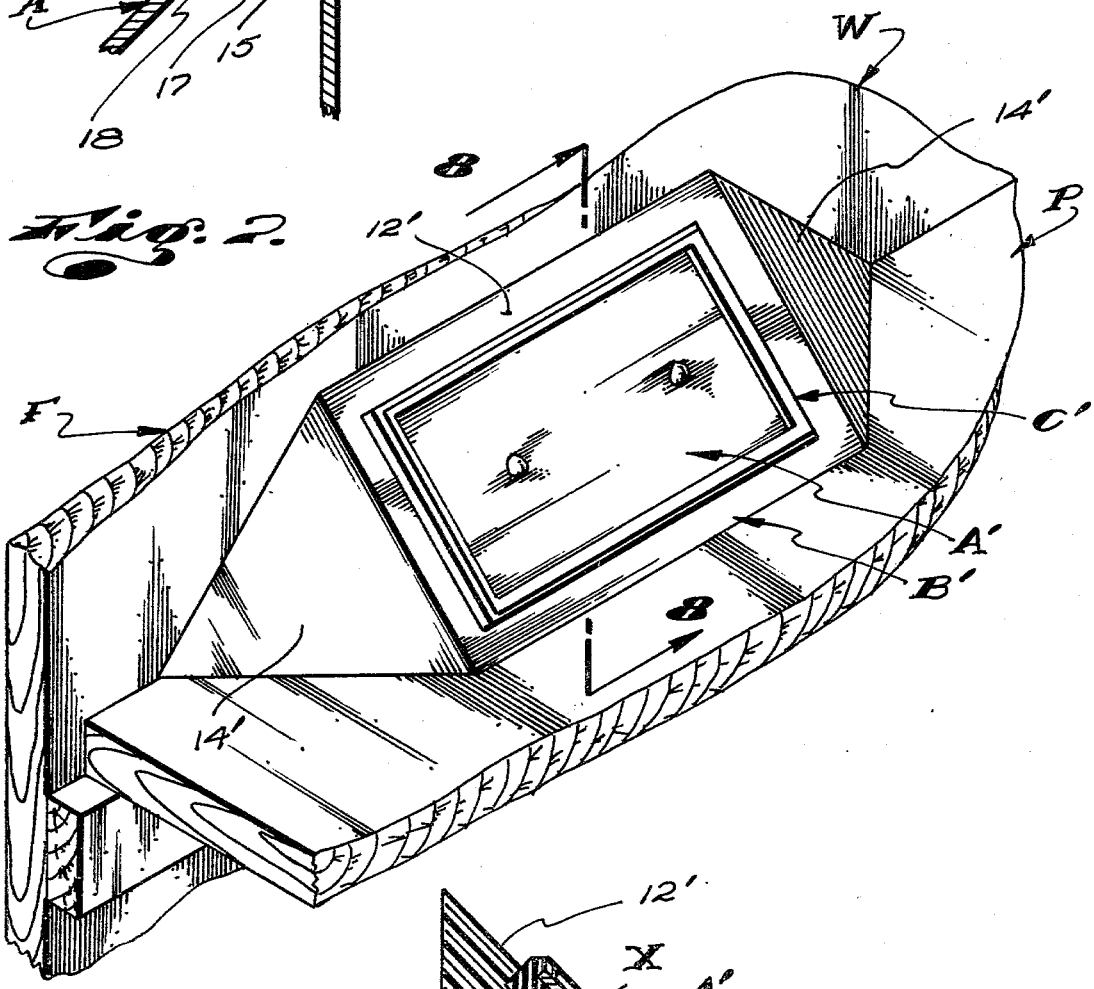

The means C can vary widely in form. In FIG. 6 of the drawings, the means C is shown as including apertures 15 in the flanges 12 of the body B, posts 16 carried by the plate A and projecting substantially downwardly and outwardly therefrom and through the apertures 15 in the flanges 12 and retainers 17 on the posts to prevent withdrawing of the posts from engagement in the apertures. The means C next includes cushioning means between the opposing surfaces of the flanges 12 and the plate A. The cushioning means can include soft rubber grommets about the posts and between the flanges and the plate or can, as shown, include an elongate resilient ribbon or cushion strip 18 along each flange 12 to engage the opposing surface of the plate A and through which the posts 16 project.

The posts 16 are shown as simple screw fasteners engaged through and projecting from the plate A and the retainers are shown as nuts engaged on the fasteners or posts.

The cushion strip 18 can be established of resilient foam plastic or rubber.

The vibrator V is a conventional commercially available electro magnetic vibrator unit and is arranged substantially central on and is fixed to the lower outer surface of the plate A by screw fastening means. The unit U projects freely from the plate into the confines of the body B, as clearly shown in FIGS. 4 and 5 of the drawings. The particular vibrator V shown in the drawings is only intended to illustrate one typical form of vibrator that can be advantageously used in carrying out your invention.

With the structure thus far described, it will be apparent that the plate A is vibrated by the vibrator V and moves or vibrates substantially independent of the body B, frame F and platform P. The water filled mattress M (and liner L) is in direct supported relationship with the plate A whereby the motion imparted into the plate A by the vibrator V is conducted directly into and through the mattress.

The sound insulating means I that we provide is established in part by the resilient cushion strips 18 of the means C and further includes triangular shaped blocks of cellular sound insulating material pressfitted into each open end of the body B, as clearly shown in FIGS. 4 and 5 of the drawings.

The vibrator V is supplied with power by means of an elongate power supply cord 20, one end of which is connected with the vibrator V. The other end of the cord extends to and is connected with a remote power supply (not shown). The cord 20 extends from the vibrator V through an end of the body B and the sound insulating block therein. The cord 20 can then extend through and away from the bed structure in any one of a number of different ways. For example, it can extend down through an opening in the platform P and thence out through an opening in the side wall W, as shown in FIG. 2 of the drawings. Alternatively, the cord 20 can extend directly out through an opening in the side wall W, as shown in dotted lines in FIG. 2 of the drawings. If desired, the cord can extend upwardly from the unit between the side wall W and the mattress M and thence over the rim or upper edge of the frame F, without departing from the spirit of our invention.

It is important to note that our unit U occurs at one side of its related mattress, at the lower edge or corner thereof and that the plate A is angularly disposed so that the forces or motion imparted by it are directed laterally inwardly and upwardly into the mattress M and toward the upper portion of the mattress on which a person normally lies. Accordingly, though the unit U occurs at one side of the mattress, it directs and is effective to deliver vibrating motion substantially directly to the body of a person lying on top of the mattress.

It is also important to note that while the unit U is rather large, it is arranged within the bed frame and platform structure and relative to the mattress in such a manner that it does not establish an objectionable or dangerous protruberance or obstruction which might adversely affect or interfere with normal and satisfactory use of the bed.

Figure 8:
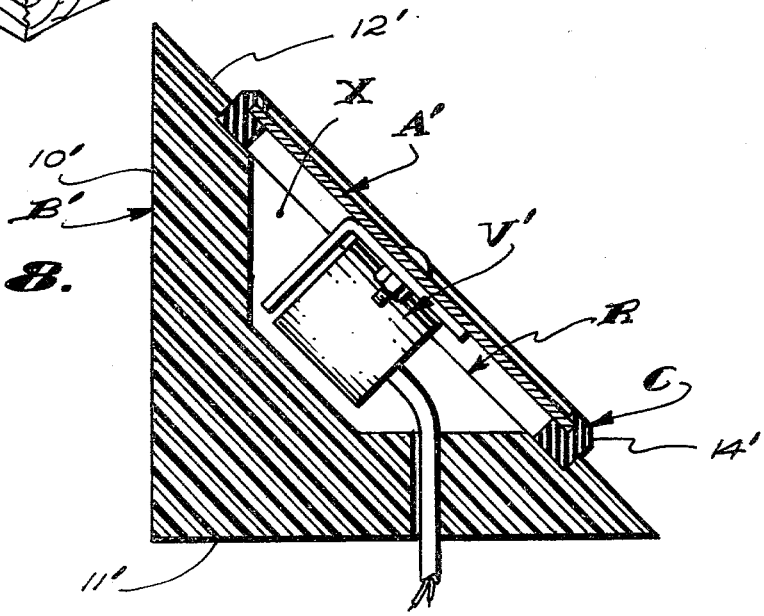
FIG. 8 is a sectional view taken by line 8—8 on FIG. 7.

In FIGS. 7 and 8 of the drawings, we have shown another form of our invention. In this second form of the invention, the body B′ is established of wood or of a structurally strong and dimensionally stable foam plastic. The body B′ is triangular in cross-section and defines a vertical wall engaging outer side 10′, a horizontal platform engaging bottom side 11′ and a laterally inwardly and upwardly inclined inner side 12′. The body has longitudinally outwardly extending longitudinally outwardly convergent fairings 14′ at its ends. The fairings have vertical and horizontal outer and bottom sides in common planes with the outer and bottom sides of the body per se and have inner sides which are inclined downwardly and rearwardly relative to the ends of the inner side of the body per se, as they extend longitudinally outwardly therefrom.

The inner side 12′ of the body is provided with a central inwardly and upwardly disposed rectangular recess R to accommodate the plate A′ and has a cavity X formed therein to accommodate the vibrator V′ which is carried by the plate A. The mounting means C′ in this form of our invention comprises a resilient rubber gasket 18′ cemented or otherwise fixed in and extending about the perimeter of the recess R. The gasket 18′ has an inwardly opening channel about its inner perimeter and in which the outer edge portion of the plate A is releasably engaged.

The unit U′ is related to the platform P and side wall W of a related water bed in the same form as is the first form of our transducer and is essentially the same as our first form of transducer as regards its operation.

In practice, the electro magnetic vibrators provided to impart effective vibratory motion in the large mass of water in a water bed must have a long stroke and must operate at a lower or moderate frequency. Further, the drive plates must be of substantial size and present a large surface area in order to assure direct movement of an adequate volume of water to gain the desired end result.

It has been determined that if the large drive plates in such devices are imparted with limited flexibility, the motion imparted into the water, as they are moved by the vibrators, is noticeably increased or enhanced.

In accordance with the above, and in the preferred carrying out of our invention, the drive plate A is imparted with a limited, predetermined degree of flexiblity. To the above end, the plate A is established of a resilient metal, and is made sufficiently thin so that desired flexibility is imparted into it.

In practice, the plate A could be made of hard, resilient rubber or the like so that it has desired flexibility without departing from the spirit of our invention.

From the foregoing, it will be apparent that we have invented an improved transducer unit for use in combination with water beds and an improved and novel water bed structure with transducer means.

Having described only typical preferred forms and applications of our invention, we do not wish to be limited to the specific details herein set forth but wish to reserve to outselves any modifications and/or variations that may appear to those skilled in the art and which fall within the scope of the following claims:

Having described our invention, we claim:

1. In combination, a water bed structure including a frame with at least one vertical side wall, a horizontal platform within the frame and a water filled bladder mattress contained within the frame adjacent said side wall and supported on the platform, a transducer unit including an elongate body arranged in a portion of the corner defined by the platform and said wall and having an outer side engaged with said wall, a bottom side engaged with said platform and an upwardly and inwardly disposed inner side opposing the mattress, a plate positioned between the mattress and the inner side of the body and supporting the portion of the mattress adjacent the unit, resilient coupling means coupling the plate with the body for limited relative movement therebetween and an electro-magnetic vibrator fixed to said plate and projecting freely into the body.

2. The structure set forth in claim 1 wherein the plate has longitudinally outwardly extending and longitudinally outwardly divergent fairing at its opposite ends projecting freely into portions of the corner at opposite ends of the body.

3. The structure set forth in claim 1 wherein the body has longitudinally outwardly convergent fairing extending longitudinally from its opposite ends and terminating in the portions of the corner remote from the ends of the body.

4. The structure set forth in claim 1 wherein the coupling means includes resilient means engaged with and between a plate and the body resiliently supporting the plate in spaced relationship from the body for free relative movement.

5. The structure set forth in claim 4 wherein the plate has longitudinally outwardly extending and longitudinally outwardly divergent fairing at its opposite ends projecting freely into portions of the corner at opposite ends of the body.

6. The structure set forth in claim 4 wherein the body has longitudinally outwardly convergent fairing extending longitudinally from its opposite ends and terminating in the portions of the corner remote from the ends of the body.

* * * * *